United States Patent [19]

Dolle

[11] 4,111,375

[45] Sep. 5, 1978

[54] PROCESS AND EQUIPMENT FOR THE PRODUCTION OF A YARN TAIL

[75] Inventor: Meinolf Dolle, Berlin, Fed. Rep. of Germany

[73] Assignee: Spinnstoffabrik Zehlendorf Aktiengesellschaft, Berlin, Fed. Rep. of Germany

[21] Appl. No.: 783,606

[22] Filed: Apr. 1, 1977

[30] Foreign Application Priority Data

Apr. 2, 1976 [DE] Fed. Rep. of Germany ..... 2614252

[51] Int. Cl.[2] ..... B65H 54/02; B65H 54/34

[52] U.S. Cl. ..... 242/18 PW

[58] Field of Search ..... 242/18 PW; 57/34 TT, 57/34 PW

[56] References Cited

U.S. PATENT DOCUMENTS

| | | | |
|---|---|---|---|
| 2,244,492 | 6/1941 | Karns | 242/18 PW X |
| 3,075,715 | 1/1963 | Hensen et al. | 242/18 PW |
| 3,520,483 | 11/1967 | Swallow | 242/18 PW |
| 3,792,818 | 2/1974 | Bauer et al. | 242/18 PW |
| 3,819,123 | 6/1974 | Luz | 242/18 PW |
| 3,921,921 | 11/1975 | Katayama et al. | 242/18 PW X |
| 3,940,075 | 2/1976 | Lenk | 242/18 PW |
| 3,952,959 | 4/1976 | Shaw et al. | 242/18 PW |

FOREIGN PATENT DOCUMENTS

| | | | |
|---|---|---|---|
| 1,038,422 | 8/1966 | United Kingdom | 242/18 PW |

*Primary Examiner*—Stanley N. Gilreath
*Attorney, Agent, or Firm*—Connolly and Hutz

[57] ABSTRACT

After formation of a yarn pre-build a yarn tail is produced on a package tube. The yarn is guided with the aid of a yarn traverse guide and caught by an auxiliary yarn guide during formation of the yarn pre-build. It is important that, after the formation of the yarn pre-build and before reaching the traverse end, the yarn is brought out beyond the latter by means of the auxiliary yarn guide which follows the yarn traverse guide in the running direction of the yarn. It is also important that, while being caught by the auxiliary guide, the yarn remains in the yarn traverse guide. In this manner the yarn tail is formed outside the traverse width. Thereafter the auxiliary yarn guide releases the yarn to the yarn traverse guide and the final package is built.

14 Claims, 3 Drawing Figures

7
7'
10
10'
4
1
2
3
6
5
16
14
15
18

1
1'
2
3
3'
4
4'
5
6
8
9
10
11
12
13
14
15
16
17
18

PROCESS AND EQUIPMENT FOR THE PRODUCTION OF A YARN TAIL

The invention relates to a process for the production of a yarn tail on package tubes, after formation of a yarn pre-build, with the aid of a yarn traverse guide and an auxiliary yarn guide, and to equipment for carrying out this process.

Yarn tails serve to present, to the individual positions of the machines for further processing, several packages which can run successively without interruption, that is to say without stopping the machine. This is achieved by knotting the end of one package to the beginning of the next, the end of which is joined to the beginning of the next-but-one package, and so on.

Numerous processes are known, based on very diverse principles, for producing a yarn tail, which may have a length of several meters. The length of the yarn tail is to a large extent dependent on the yarn take-off speeds. The yarn tail can consist of up to 30 wraps round the package tube. The number of wraps is essentially dependent on the tube diameter. Common to all yarn tails is their sufficiently large separation (about 10–30 mm) from the package build, so that the yarn tail is satisfactorily available for customer requirements.

With the high-speed spinning processes, partly operating without godets, developed in recent years, a yarn which has been partially drawn in such a way that it can be passed directly to the texturizing processes is produced. This results in the requirement for a yarn tail on the spun package.

There are two basic processes to be distinguished. In the one, a yarn tail is formed immediately at the start of the wind-up; in the other, a yarn pre-build is first formed, then the yarn tail is formed, and only thereafter does the final package build start.

The second process has mainly found acceptance for wind-up machines using large diameter tubes. Whereas small tubes as a rule are cheap throw-away tubes, the expensive large tubes are used many times. This results in the need for a yarn pre-build, since the tube surface, which becomes worse (rougher) each time the tube is used, prevents winding off the yarn right down to the tube. With this process it is essential to ensure that the yarn tail zone is always at the same end of the tube. It must be clearly marked (with color) in order to be able to protect it specially.

Since the yarn pre-build is already being wound across the whole width of the tube with the aid of the yarn traverse guide, a device must be provided to enable the yarn to be momentarily taken out of the zone corresponding to the stroke of the yarn guide, in order to form the yarn tail.

The known processes work on the following principle: the yarn is lifted out of the yarn guide during the traverse, brought to the side into the yarn tail zone and, after formation of the tail winding, returned to the yarn guide. As a rule, the latter is so constructed that it can catch the yarn automatically. This is possible because, as a result of the yarn tension, the yarn always tends to seek the middle point of the traverse, and thus approaches the yarn guide.

However, all these processes have a crucial disadvantage: in catching the yarn after forming the tail winding, it can happen that individual filaments of the yarn are not all caught simultaneously. These single filaments can "roam" momentarily and will, in their slack position, be overlapped by succeeding yarn wraps. As a result, the package is certainly damaged at the very point where it should enable, and ensure, the changeover to the next package, that is to say the yarn tail cannot fulfil its function.

A further disadvantage of this process is that in general the yarn tails are much too long. They have therefore to be cut in the winding shop, reduced to a satisfactory length for customer requirements and subsequently stuck down onto the tube. These operations must be carried out with the greatest care in order not to damage the yarn. In addition, there is the not inconsiderable labor involved, which appears superfluous when one considers that the operator of the following process must in any case handle the yarn tails for knotting-on.

It is therefore the object of the invention to provide a process which enables a usable yarn tail to be produced after formation of a yarn pre-build, and which at the same time does not exhibit the disadvantages described above. A further object of the invention is to provide a device for carrying out this process. At the same time, the yarn tail should be formed automatically.

This object has been achieved, surprisingly, by a process wherein, after formation of the yarn pre-build, the yarn, before reaching the traverse end, is brought out beyond the latter by means of the auxiliary yarn guide, which follows the yarn traverse guide in the running direction of the yarn, whilst the yarn at the same time remains also in the yarn traverse guide, the yarn tail is then formed outside the traverse width, in the yarn tail zone, and thereafter the auxiliary yarn guide releases the yarn for the final package build. According to a preferred embodiment, the auxiliary yarn guide is a rod. According to a further preferred embodiment, the auxiliary yarn guide is a pivotable rod. Preferably, the pivotable rod can pivot about a vertical axis. It is especially preferred that the piovtable rod can pivot about an axis, the lower part of which is inclined towards the package. According to a further preferred embodiment, the rod, in its rest position, lies parallel to the track of the yarn traverse guide.

These processes are advantageously carried out with equipment comprising a yarn traverse guide, a package wind-up unit and an auxiliary yarn guide, together with the associated drives, wherein the auxiliary yarn guide and its drive are situated below the yarn traverse guide. Preferably, the auxiliary yarn guide is a rod pivotable about a fixed axis. It is very particularly preferred that the fixed axis is vertical. Furthermore, it is advantageous that the lower part of the fixed axis is inclined towards the package wind-up unit. According to a further particularly suitable embodiment of the equipment according to the invention, the pivotable rod is extended beyond the fixed axis, up to a second, movable pivot axis which is connected to the producer of a translational motion.

An auxiliary yarn guide is provided below the traverse yarn guide, on the casing of the traversing equipment. In the text which follows, the equipment and process will be discussed in relation to the illustrative embodiment in which the auxiliary yarn guide is a rod. The rod is situated on the side of the tube facing the yarn winding-on point; in its position of rest, it lies approximately parallel to the track of the yarn traverse guide; in its projecting position, which it reaches after pivoting about the stationary axis 2, it leads the yarn into the yarn tail zone of the package tube.

BRIEF DESCRIPTION OF THE DRAWINGS

Novel features and advantages of the present invention will become apparent to one skilled in the art from a reading of the following detailed description in conjunction with the accompanying drawings wherein similar reference characters refer to similar parts and in which:

FIG. 1 shows a possible embodiment of the invention in a perspective view in which, for the sake of clarity, the tension spring 11 has been omitted. In FIGS. 1–3, 1 denotes the rod, 2 the stationary axis, 3 the extension, 4 the pivot point, 5 the translational drive, 6 the piston, 7 the yarn, 8 the traversing stroke length, 9 the yarn tail zone, 10 the yarn traverse guide, 11 the tension spring, 12 the opposite traverse end, 13 the trigger, 14 the drive shaft, 15 the chuck, 16 the tube, 17 the take-over zone, 18 the yarn pre-build, 1' the rod in the rest position, 3' the extension in the rest position, 4' the pivot point in the rest position, 7' the yarn returning and 10' the yarn traverse guide returning. Rod 1 is extended a little beyond its pivot point 2 about the stationary axis. At the end of this extension 3 there is a further pivot point 4, on which the piston 6 of a translational drive 5 acts. If now the drive 5 pulls the piston 6 from its projecting position, when at rest, into the direction of the middle of the traverse, the rod 1 executes a sweeping movement out from its rest position towards the yarn 7 and, with the angle of pivot being from 60°–120°, preferably 80°–100° and especially 90°, guides it outside the traverse zone by an amount which corresponds to the distance of the stationary axis 2 from the end of the stroke of the yarn traverse guide 10. The optimum is achieved if the stationary axis is located as far beyond the end of the stroke as the yarn tail is to be placed beyond the package build, for example 10 mm.

Figure 1:
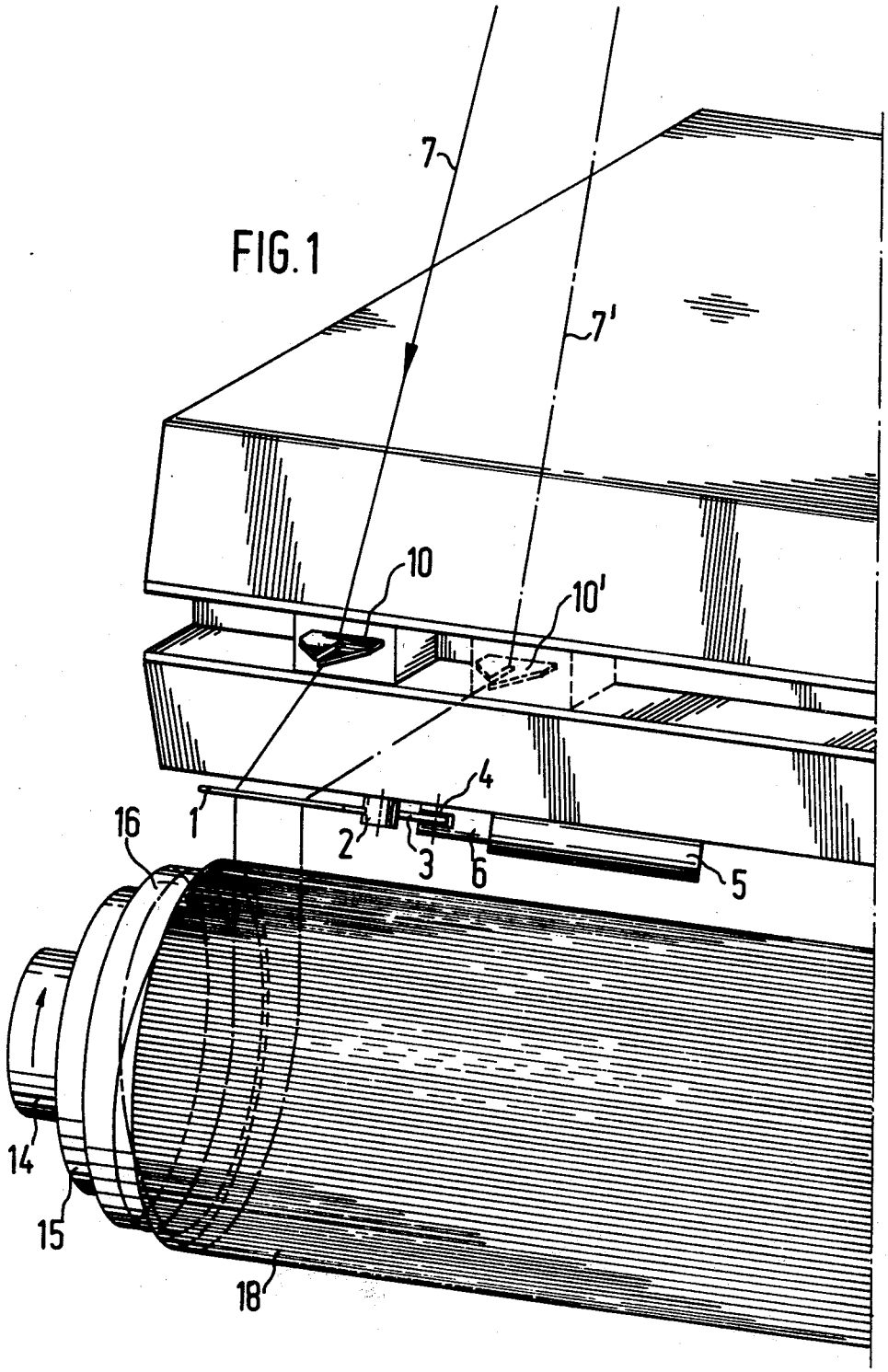
FIG. 1 is a perspective view of a device, which is one embodiment of the present invention performing the process of this invention.
Figure 2:
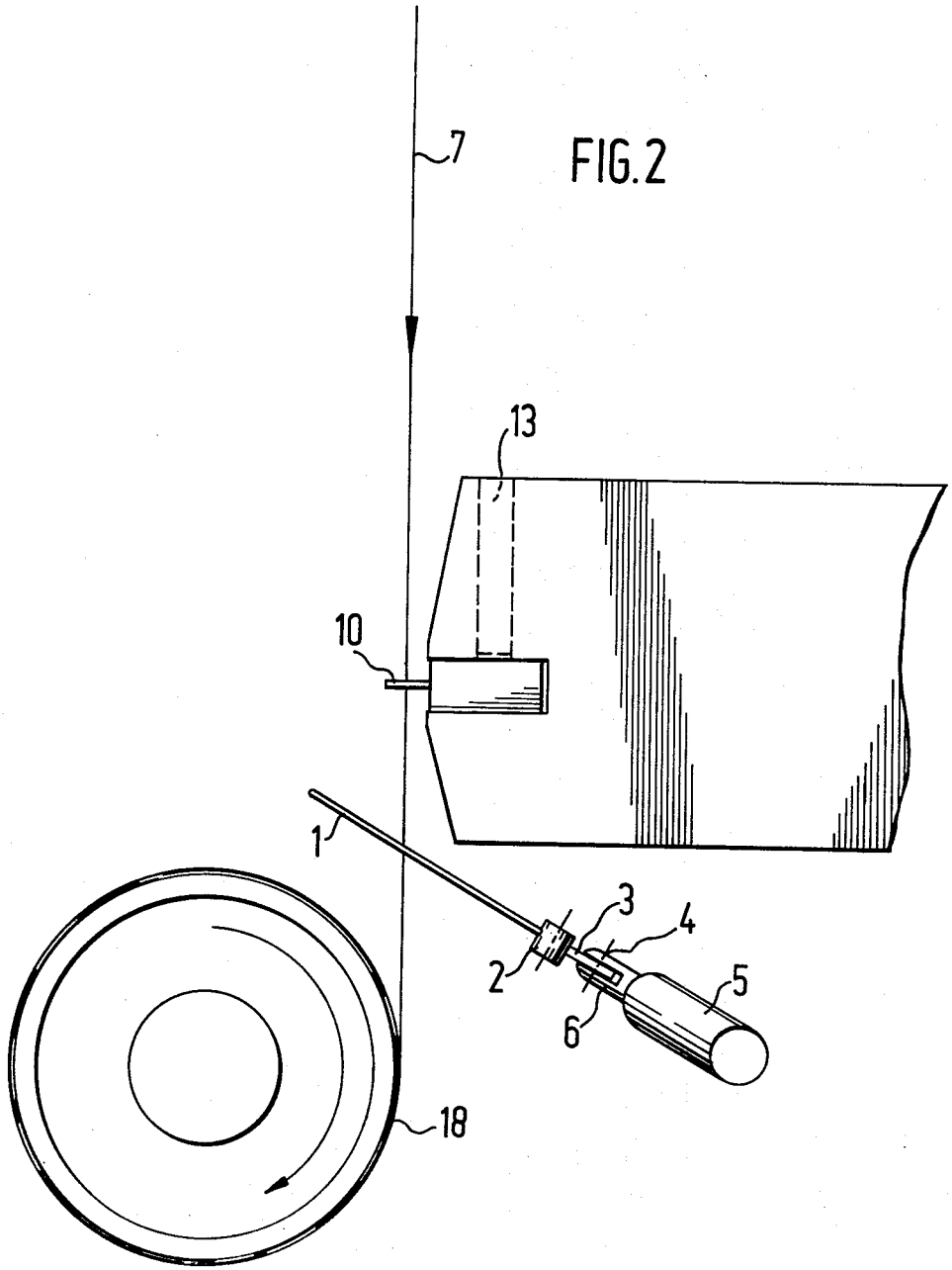
FIG. 2 is a right end view of the embodiment shown in FIG. 1.

The position of the rod 1, for which a diameter of 1 mm is sufficient, ensures that the yarn remains in the yarn traverse guide 10 during the entire process of forming the yarn tail. See, in this context, FIG. 2, which is a side view looking from the yarn winding point side, and in which the tension spring 11 is again not shown.

Figure 3:
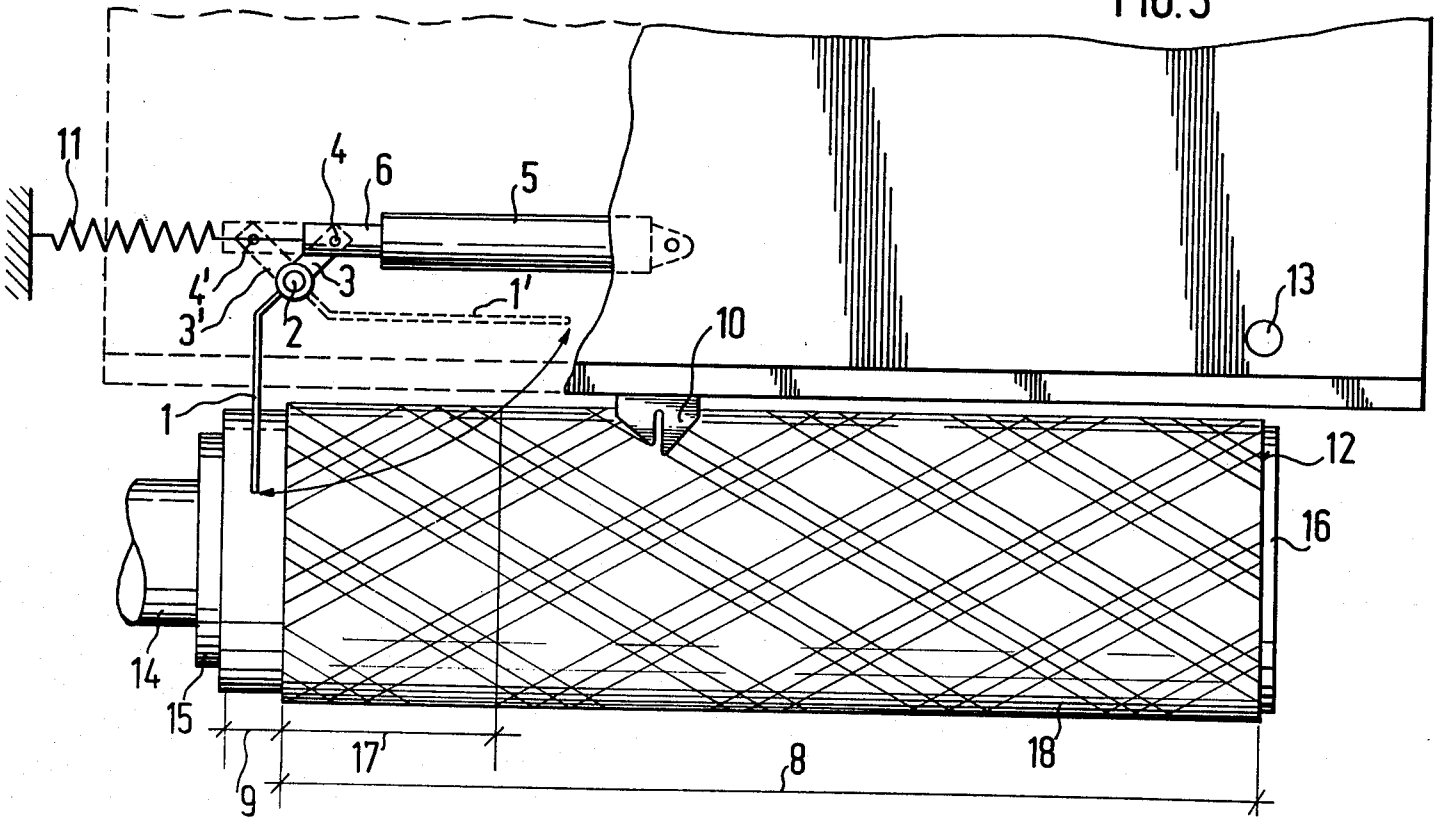
FIG. 3 is a top plan view with part of the yarn traversing portion broken away of the embodiment shown in FIGS. 1 and 2.

The formation of the yarn tail must take place extremely rapidly since, with the traverse frequencies customary at the present time, the maximum time available for the operation of forming the yarn tail is very short. Since the rod length is only a fraction of the traverse stroke length 8, the time of the start of the sweep of the rod 1 must be capable of being set accurately and with the greatest reproducibility, for only thus can it be guaranteed that the rod 1 can grip the yarn 7 and bring it into the yarn tail zone 9. FIG. 3 shows, in plan view, the track of the pivot rod 1 and its take-over zone 17 of the yarn 7.

The drive proposed for the rod 1 is, for example, an electromagnet, in order to work with minimum delay. Of course, pneumatic and hydraulic linear pistons are also possible. In a modified embodiment, the transformation of a translational motion to a rotational motion can be dispensed with by using rotary drives, such as rotary magnets or pneumatic or hydraulic rotary cylinders.

The length of the yarn tail depends on the selected duration of the impulse feeding the solenoid or, in general terms, on how long the rod 1 remains deflected. This impulse duration must also be capable of precise setting and must not exceed a maximum value, which in turn substantially depends on the speed details of the package-winding machine. The sequence of events is as follows: shortly before the yarn traverse guide 10 enters the take-over zone 17, the rod 1 is deflected, the timing of this deflection being precisely such that the rod follows the yarn 7 and reaches it before the traverse end is reached. The rod 1 now pushes the yarn 7 briefly beyond the traverse end into the yarn tail zone 9 of the tube 16 and flips back into its rest position. This happens so rapidly that the yarn traverse guide, on its travel to the opposite traverse end, has barely left the take-over zone 17 and is already once again winding-on in the zone of the final build.

In most cases encountered in practice, the duration of the impulse will be in the range from 10 to 50 milliseconds. The duration of the impulse is of critical importance with regard to the quality of the yarn tail, because the yarn traverse guide 10 does not release the yarn 7 over the entire duration of the formation of the yarn tail. The duration of the impulse should be so short that the yarn should not suffer any over-stretching whilst the yarn tail is being formed.

Depending on the parameters of tube diameter, yarn takeoff speed, traverse frequency and impulse duration, the yarn tail formed may vary from less than one up to several wraps round the package tube. The impulse duration, which is the most readily variable parameter, will, for a fixed diameter of the tubes, and for optimum yarn take-off speeds and traversing speeds, always be set to the value corresponding to the desired yarn tail length.

In an advantageous embodiment, which furthermore is inexpensive and simple, the return force of the rod 1 is provided by a tension spring. This has the additional advantage that the force is constantly applied and comes into play, without any delay, after the impulse feeding the magnet has been switched off. Apart from the tension spring 11, it is, of course, also possible to use pneumatic or hydraulic double-acting linear or rotary pistons for the forward stroke and/or return stroke.

An essential feature is that the operating impulse be applied to the rod 1 at a defined point in time. Since the high speeds and short times involved are beyond the limit of human reactions, it is necessary to allow the sequence to occur automatically, by "pressing the button" at a point in time decided by the package-winding operative.

The exact triggering time for the movement of the pivoting rod is advantageously provided by the yarn traverse guide itself, in particular indirectly via a trigger 13 which advantageously is located at the traverse end opposite the yarn tail zone and is capable of sensing the traversing yarn guide, either by contact or, in a more advantageous embodiment, by proximity detection.

In another feasible but complicated embodiment, a grooved drum can be utilized to trigger the yarn tail formation provided it is ensured, by constructional means or controls, that at the triggering time the yarn traverse guide occupies a defined and known position. This may suitably be achieved, for example, in terms of the number of revolutions of the drum after the yarn has made contact with the bobbin, or in terms of the length of time for which the drum has run from then onwards.

When the operator, as it were, calls for the yarn tail by pressing the button, he thereby renders the trigger 13 momentarily receptive, that is to say on the next approach of the yarn traverse guide 10 the impulse causing the rod 1 to sweep will be delivered, with a precise time delay. The yarn tail is then formed in the course of the next stroke.

It is conceivable to make the time delay sufficiently long that the yarn traverse guide 10 will execute several strokes between the triggering of the impulse and the sweep of the rod 1, but the version first described is more advantageous because, in practice, the traversing speed increases and decreases in a regulated manner within a fixed range (a process referred to as modulation), in order to build a better package. Since the time delay is intended to be constant in the proposed embodiment, but the stroke times vary constantly because of the modulating, the first version is more advantageous.

The embodiment described presupposes that the operator is left to decide when the yarn pre-build is considered adequate to start the final package build by initiating the production of the yarn tail. In a modified form of the invention, the duration of the yarn pre-build, after bringing the yarn onto the package tube, can be included in the automatic controls, which is in any case the situation with package-winding machines with automatic package change.

The time delay between the triggering of the impulse and the sweep of the rod 1 is always selected to be sufficiently large that both at the highest and at the lowest speed of the yarn traverse guide (resulting from modulation) the yarn is reached by the auxiliary yarn guide after the yarn has reached the takeover zone 17 but before it has reached the traverse end.

It is a basic concept and further advantage of the invention that it provides a design for the production of a yarn tail winding after producing a yarn pre-build, which design can, because of its simple technical principle, be applied to a great diversity of types of machines; in this context it should be emphasised that the required short switching times, with the required reproducibility, can advantageously be realised by means of the known electronic systems of construction.

The invention is advantageously applicable to bobbin winders with (a) one winding or several windings per package holder or (b) one winding (one yarn) or several windings (yarns) per yarn traverse guide.

Expressed in general terms, the number of auxiliary yarn guides (rods) forming the yarn tail is equal to the number of yarn traverse guides.

We claim:

1. A process for producing a yarn tail on yarn package tubes upon which yarn is wound in a pattern including a traverse zone by the yarn traverse guide and a yarn tail zone disposed beyond the traverse zone by an auxiliary yarn guide comprising the steps of initially forming a yarn pre-build on a tube with the yarn engaged by the yarn traverse guide, engaging the yarn by the auxiliary yarn guide before the yarn traverse guide has reached the end of its traverse zone with the auxiliary yarn guide following the yarn traverse guide in the direction in which the yarn is being run in the pre-build on the tube, independently moving the auxiliary yarn guide beyond the end of the traverse zone of the yarn traverse guide while the yarn still remains engaged in the yarn traverse guide whereby a yarn tail is wound outside the traverse zone in the yarn tail zone with both the auxiliary and traverse guides engaged with the yarn, and thereafter releasing the auxiliary yarn guide from the yarn for forming the final package build under the guidance of the yarn traverse guide.

2. A process as claimed in claim 1, wherein the auxiliary yarn guide is a rod.

3. A process as claimed in claim 2, wherein the auxiliary yarn guide is a pivotable rod.

4. A process as claimed in claim 3, wherein the rod can pivot about a substantially vertical axis.

5. A process as set forth in claim 3, wherein the rod is pivotal about a substantially vertical axis, the substantially vertical axis having one end disposed adjacent the yarn traverse guide and the other end disposed adjacent the yarn package on the tube, and the other end disposed adjacent the yarn package on the tube being inclined toward the yarn package on the tube.

6. A process as set forth in claim 2, wherein the rod has a rest position in which it is disengaged from the yarn, and in the rest position the rod being disposed substantially parallel to the path of movement of the yarn traverse guide.

7. A process as set forth in claim 1, wherein the portion of the traverse zone adjacent the yarn tail zone is a takeover zone, and the auxiliary yarn guide engages and releases the yarn in the yarn takeover zone prior to and after moving the yarn into the yarn tail zone.

8. An apparatus for producing a yarn tail on yarn package tubes comprising a reciprocating yarn traverse guide for traversing the yarn relative to the tube through a traverse zone, an auxiliary yarn guide movably mounted on the apparatus for limited movement following the yarn traverse guide in the direction in which the yarn is being traversed on the tube in the traverse zone, auxiliary moving means for independently moving the auxiliary yarn guide within a relatively short takeover zone within the end of the traverse zone and then shortly beyond the traverse zone in a yarn tail zone in which the yarn is formed in a yarn tail on the tube extending beyond the traverse zone, actuating means operatively connected to the auxiliary yarn guide for maintaining the auxiliary yarn guide disengaged from the yarn while it is being formed in a pre-build in the traverse zone prior to the actuation of the auxiliary yarn guide, trigger means operatively connected to the auxiliary moving means for causing the auxiliary thread guide to engage the yarn in the takeover zone following the movement of the yarn traverse guide whereby the auxiliary yarn guide engages the yarn and moves it into the yarn tail zone while it is still engaged by the yarn traverse guide for forming the yarn tail on the tube, and the actuating means being arranged to cause the auxiliary yarn guide to move away from the yarn in the takeover zone and release the yarn from the auxiliary yarn guide after forming the yarn tail and allowing the yarn traverse guide to resume guiding the yarn through the traverse zone whereby the yarn build is formed on the yarn tube after forming the yarn tail.

9. An apparatus as set forth in claim 8, wherein the auxiliary yarn guide comprises a rod, a fixed axis of rotation, and the rod being rotatably mounted on the fixed axis of rotation.

10. An apparatus as set forth in claim 9, wherein the fixed axis of rotation is substantially vertically disposed.

11. An apparatus as set forth in claim 10, wherein the fixed axis of rotation has a portion disposed adjacent the yarn tube, and the portion adjacent the yarn tube is inclined towards the yarn tube.

12. An apparatus as set forth in claim 9, wherein said auxiliary moving means includes drive means, and pivotal connecting means coupling the drive means to the auxiliary yarn guide.

13. An apparatus as set forth in claim 12, wherein said drive means is provided for the rod, and said pivotal connecting means couples the drive means to an end of the rod remote from the portion of the rod which engages the yarn.

14. An apparatus as set forth in claim 13, wherein said actuating means includes spring means connected to the rod for urging it into disengagement from the yarn.

* * * * *